US006164260A

United States Patent [19]

Bock

[11] Patent Number: 6,164,260

[45] Date of Patent: Dec. 26, 2000

[54] SCRAPING RING AND SEALING RING USED WITH A CYLINDER LINER IN AN INTERNAL COMBUSTION ENGINE

[75] Inventor: Allyn P. Bock, West Lafayette, Ind.

[73] Assignee: Caterpillar Inc., Peoria, Ill.

[21] Appl. No.: 09/351,880

[22] Filed: Jul. 13, 1999

[51] Int. Cl.[7] ..... F02F 1/00

[52] U.S. Cl. ..... 123/193.2; 123/668; 29/888.06

[58] Field of Search ..... 123/193.1, 193.2, 123/193.3, 668; 277/550, 591; 29/888.06, 888.061

[56] References Cited

U.S. PATENT DOCUMENTS

| | | | |
|---|---|---|---|
| 3,396,711 | 8/1968 | Fangman et al. . | |
| 3,489,130 | 1/1970 | Polidan et al. . | |
| 4,244,330 | 1/1981 | Baugh et al. | 123/41.84 |
| 4,474,147 | 10/1984 | Hoopes | 123/193.1 |
| 4,791,891 | 12/1988 | Kubis et al. | 123/41.84 |
| 4,867,118 | 9/1989 | Kubis et al. | 123/193.3 |
| 5,010,853 | 4/1991 | Kubis et al. | 123/41.84 |
| 5,265,563 | 11/1993 | Kubis et al. | 123/41.83 |
| 5,377,643 | 1/1995 | Schibalsky | 123/193.3 |

*Primary Examiner*—Noah P. Kamen
*Attorney, Agent, or Firm*—Todd T. Taylor

[57] ABSTRACT

An internal combustion engine includes a cylinder block with a cylinder bore. A cylinder head is attached to the cylinder block and covers the cylinder bore. A cylinder liner within the cylinder bore has a distal end, an inside diameter, and an annular recess extending radially outwardly from the inside diameter at the distal end. A piston is reciprocally disposed within the cylinder liner. An annular scraping ring positioned in the annular recess has an inside diameter which is smaller than the inside diameter of the cylinder liner and is configured to scrape deposits from the piston. The scraping ring extends axially beyond the distal end of the cylinder liner. An annular sealing ring is separate from, located by and positioned radially outwardly adjacent to the scraping ring. The sealing ring directly engages and seals between the cylinder head and the distal end of the cylinder liner.

7 Claims, 2 Drawing Sheets

SCRAPING RING AND SEALING RING USED WITH A CYLINDER LINER IN AN INTERNAL COMBUSTION ENGINE

TECHNICAL FIELD

The present invention relates to internal combustion engines, and, more particularly, to sealing rings used to seal between a cylinder liner and cylinder head in an internal combustion engine.

BACKGROUND ART

Internal combustion engines, such as multi-cylinder diesel or gasoline engines, typically include a cylinder block defining a plurality of cylinder bores which reciprocally carry respective pistons therein. Each cylinder bore may include a cylinder liner in which the piston actually reciprocates. Cylinder liners allow a cylinder block with a particular cylinder bore configuration and size to be used with multiple different diameter pistons by simply changing the cylinder liners for a particularly configured engine. Moreover, the cylinder liners may be removed and replaced if worn through use over time. Additionally, an internal combustion engine for use as a diesel engine may require a cylinder liner which is configured differently from an internal combustion engine used as a gasoline engine.

It is known to provide a sealing ring at the distal end of a cylinder liner in an internal combustion engine. An example of such a sealing ring is disclosed in U.S. Pat. No. 5,010,853 (Kubis et al.). With such a sealing ring, the distal end of the cylinder liner is disposed a distance away from the bottom side of the cylinder head. The radial force exerted on the seal therefore may be relatively large during combustion of the fuel and air mixture within the combustion chamber during operation. Accordingly, such sealing rings are typically disposed adjacent to suitable backing structure to inhibit the sealing ring from deflecting radially outward. Moreover, the pressure exerted against the sealing ring may require that relatively high clamping forces be exerted between the cylinder head and cylinder block using a large number of fasteners such as bolts, or large diameter bolts.

It is also known to provide an integral combination scraping ring and sealing ring at the distal end of a cylinder block defining a cylinder bore. U.S. Pat. No. 4,474,147 (Hoopes) discloses an annular combination fire ring and scraping insert having a generally L-shaped cross section. The combination fire ring and scraping insert has a relatively complex cross sectional shape requiring multiple bending and forming operations which all tend to affect the dimensional tolerances of the combination ring. Moreover, the multiple bending and forming operations add to the cost of the combination ring.

The present invention is directed to overcoming one or more of the problems as set forth above.

DISCLOSURE OF THE INVENTION

In one aspect of the invention, an internal combustion engine includes a cylinder block with a cylinder bore. A cylinder head is attached to the cylinder block and covers the cylinder bore. A cylinder liner within the cylinder bore has a distal end, an inside diameter, and an annular recess extending radially outwardly from the inside diameter at the distal end. A piston is reciprocally disposed within the cylinder liner. An annular scraping ring positioned in the annular recess has an inside diameter which is smaller than the inside diameter of the cylinder liner and is configured to scrape deposits from the piston. The scraping ring extends axially beyond the distal end of the cylinder liner. An annular sealing ring is separate from, located by and positioned radially outwardly adjacent to the scraping ring. The sealing ring directly engages and seals between the cylinder head and the distal end of the cylinder liner.

In another aspect of the invention, a method of assembling an internal combustion engine includes the steps of: inserting a cylinder liner within a cylinder bore of a cylinder block, the cylinder liner having a distal end, an inside diameter, and an annular recess extending radially outwardly from the inside diameter at the distal end; placing an annular scraping ring within the annular recess, the scraping ring having an inside diameter which is smaller than the inside diameter of the cylinder liner and configured to scrape deposits from the piston, the scraping ring extending axially beyond the distal end of the cylinder liner; locating an annular sealing ring separate from and radially outwardly adjacent to the scraping ring against the distal end of the cylinder liner; covering the cylinder bore with a cylinder head; and attaching the cylinder head to the cylinder block, whereby the sealing ring directly engages and seals between the cylinder head and the distal end of the cylinder liner.

BEST MODE FOR CARRYING OUT THE INVENTION

Figure 1:
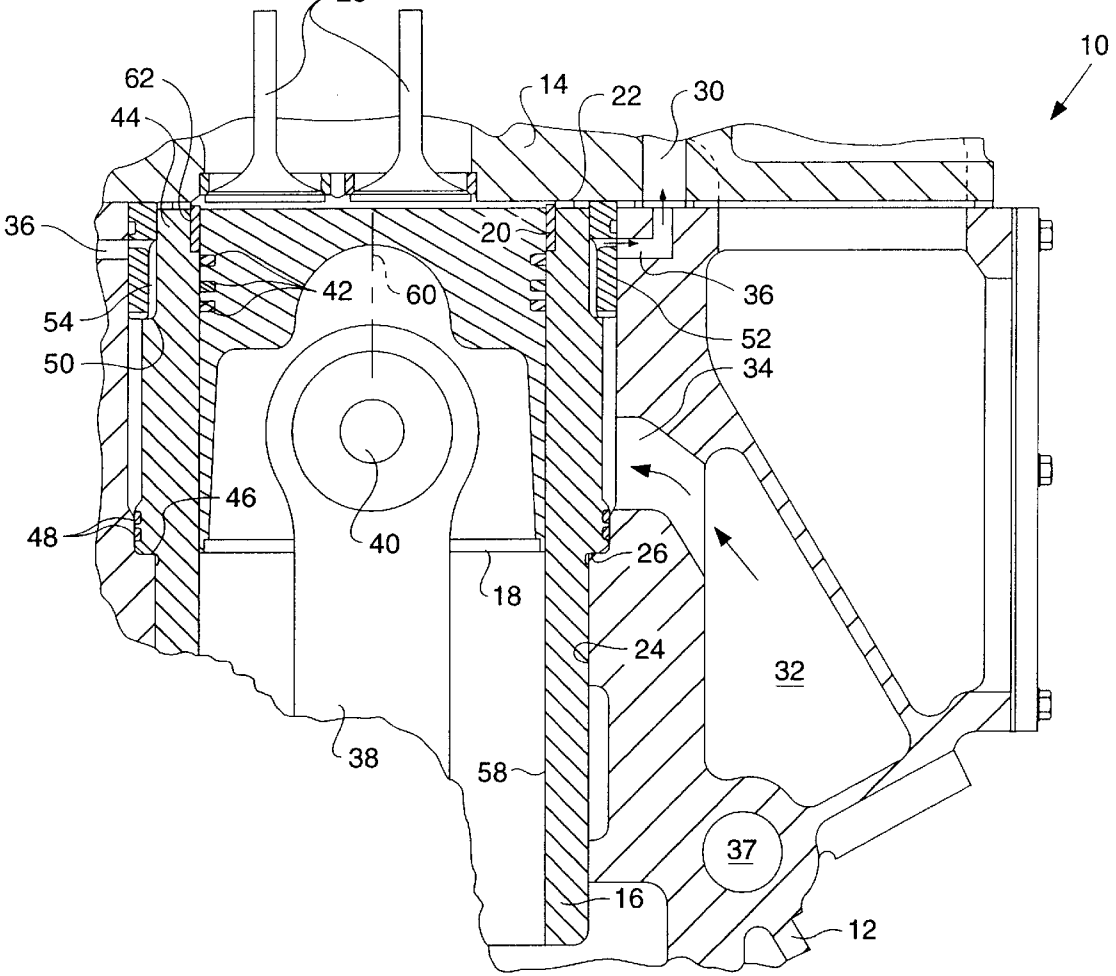
FIG. 1 is a fragmentary, sectional view of a portion of an embodiment of an internal combustion engine of the present invention.

Referring now to the drawings, and more particularly to FIG. 1, there is shown an embodiment of an internal combustion engine 10 of the present invention which generally includes a cylinder block 12, cylinder head 14, cylinder liner 16, piston 18, annular scraping ring 20 and annular sealing ring 22.

Cylinder block 12 includes a cylinder bore 24 in which cylinder liner 16 is disposed. Cylinder bore 24 includes a shoulder 26 against which cylinder liner 16 seats. Cylinder head 14 is attached to cylinder block 12 and covers cylinder bore 24. Cylinder head 14 carries a plurality of valves 28. Cylinder head 14 includes a channel 30 (shown schematically in FIG. 1) for receiving a flow of liquid coolant such as antifreeze and thereby cooling cylinder head 14.

Cylinder block 12 also includes one or more appropriately configured channels 32 through which liquid coolant is transported. One or more branch channels 34 and 36 allow a flow of liquid coolant along cylinder liner 16 and between channel 32 in cylinder block 12 and channel 30 in cylinder head 14. Channels 30 and 32, and branch channels 34 and 36 may have any suitable configuration dependent upon the specific configuration of internal combustion engine 10, and are shown schematically by phantom lines in FIG. 1 for simplicity of illustration.

Cylinder block 12 also includes one or more pressurized lubricant conduits, such as outboard oil gallery 37 which provides oil under pressure for lubrication of moving parts within internal combustion engine 10. For example, internal combustion engine 10 may be provided with porting (not shown) fluidly connected with oil gallery 37 and used to lubricate and cool piston 18 within cylinder liner 16.

Piston 18 is reciprocally disposed within cylinder liner 16, and is pivotally connected with a connecting rod 38 via a piston pin 40. An end of connecting rod 38 opposite from piston pin 40 is pivotally connected with a crank pin of a rotating crank shaft in known matter. Piston 18 reciprocates between a top dead center TDC and a bottom dead center BDC position within cylinder liner 16 during rotational movement of the crankshaft. Piston 18 may include a plurality of piston ring grooves with piston rings 42 disposed therein which allow a substantially fluid tight reciprocating movement of piston 18 within cylinder liner 16.

Cylinder liner 16 includes a distal end 44 which is disposed adjacent to cylinder head 14. Cylinder liner 16 includes a shoulder 46 which abuts against shoulder 26 of cylinder block 12. Shoulder 46 is disposed a predetermined axial distance away from distal end 44 of cylinder liner 16. In the embodiment shown, shoulder 46 is disposed at approximately the same distance as the bottom of piston 18 when piston 18 is at a TDC position (as shown in FIG. 1). Configured as such, cylinder liner 16 is a mid-mounted liner. Cylinder liner 16 includes one or more annular grooves with corresponding annular seals 48 therein which seal between cylinder liner 16 and cylinder block 12.

Cylinder liner 16 also includes a second annular shoulder 50 formed on the radial exterior periphery thereof. Shoulder 50 is positioned away from distal end 44 a distance corresponding approximately to the height of a cooling ring 52. Cooling ring 52 defines an annular coolant channel 54 adjacent the radial exterior periphery of cylinder liner 16, and also includes a plurality of radially extending ports 56. Cooling ring 52 defines a predetermined flow path with a predetermined flow area and velocity which interconnects coolant channel 32 in cylinder block 12 with coolant channel 30 in cylinder head 14, and thereby cools cylinder liner 16 adjacent to distal end 44.

Cylinder liner 16 also includes an inside diameter 58 which is sized slightly larger than the outside diameter of piston 18. The inside diameter 58 of cylinder liner 16 defines a longitudinal axis 60. An annular recess 62 extends radially outwardly from inside diameter 58 at distal end 44.

Figure 2:
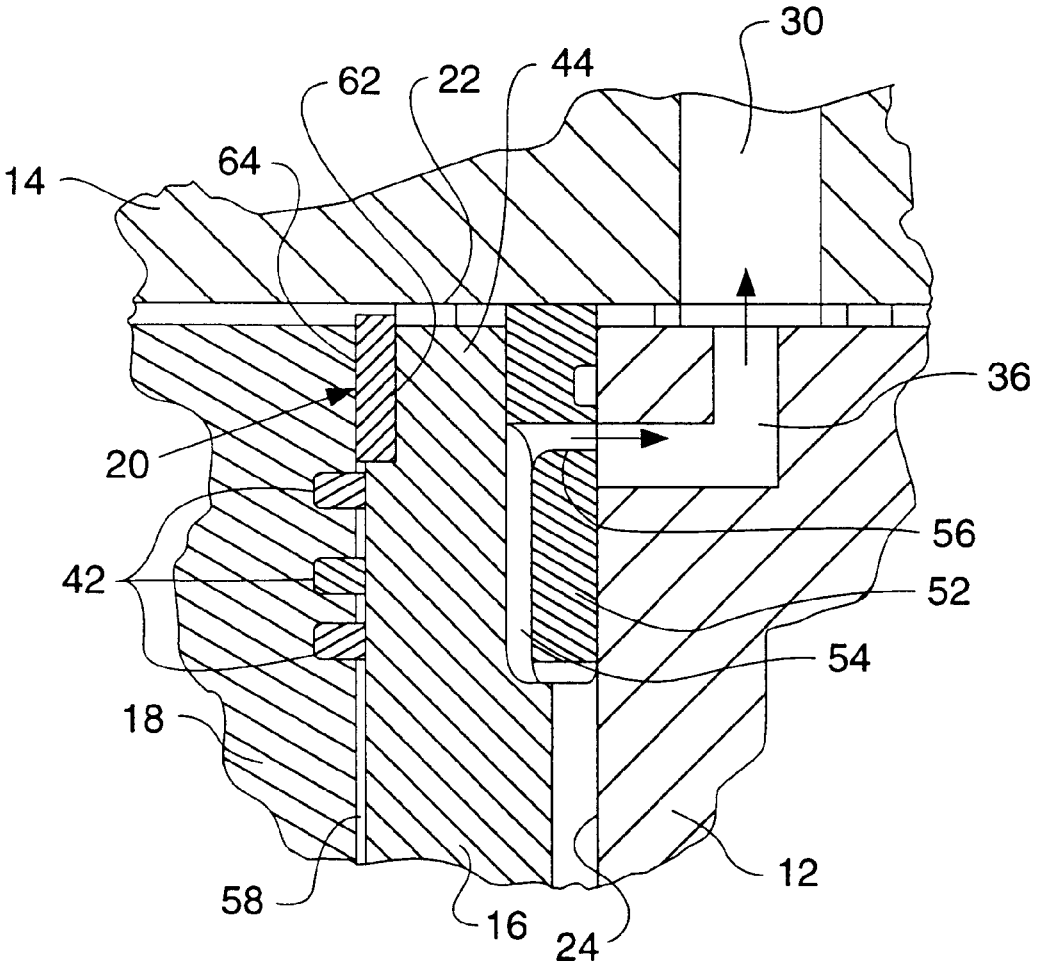
FIG. 2 is a fragmentary, enlarged view illustrating the scraping ring and sealing ring shown in FIG. 1.

Annular scraping ring 20 is positioned in annular recess 62. Scraping ring 20 has an inside diameter 64 which is smaller than inside diameter 58 of cylinder liner 16. Inside diameter 64 of scraping ring 20 is sized and configured to scrape deposits of carbon from the top end of piston 18 when piston 18 approaches the TDC position. Scraping ring 20 extends axially beyond distal end 44 of cylinder liner 16, as shown in FIG. 2. When seated within recess 62 of cylinder liner 16, scraping ring 20 is positioned at a slight clearance distance away from cylinder head 14 so that the sealing and loading between cylinder head 14 and cylinder liner 16 occurs on sealing ring 22. Scraping ring 20 may be formed from any suitable material such as a particular grade of steel. In the embodiment shown, cylinder liner 16 and scraping ring 20 are each formed from a same grade of steel, such as stainless steel.

Annular sealing ring 22 is separate from scraping ring 20. Sealing ring 22 is located by and positioned radially outwardly adjacent to scraping ring 20. Sealing ring 22 has a cross section which extends generally orthogonal to longitudinal axis 60 of cylinder liner 16. Sealing ring 22 has a thickness in a direction parallel to longitudinal axis 60 which is greater than the clearance distance between scraping ring 20 and cylinder head 14, thereby ensuring that the compression load is exerted on sealing ring 22 when cylinder head 14 is attached to cylinder block 12 using suitable fasteners, such as bolts, studs, etc. (not shown). Sealing ring 22 directly engages and seals between cylinder head 14 and distal end 44 of cylinder liner 16.

INDUSTRIAL APPLICABILITY

During use, piston 18 reciprocates within cylinder liner 16 upon rotation of the crankshaft of internal combustion engine 10. As piston 18 approaches the TDC position, scraping ring 20 positioned radially outwardly adjacent to the top end of piston 18 scrapes carbon deposits from the radial exterior periphery of piston 18. Because scraping ring 20 extends axially beyond the distal end 44 of cylinder liner 16, the area of sealing ring 22 which is exposed to high pressure upon combustion within cylinder liner 16 is reduced. This in turn means that less force is exerted on sealing ring 22 and less clamping force must be exerted between cylinder head 14 and cylinder block 12. This in turn means that the bolts which are used to attach cylinder head 14 to cylinder block 12 may have a reduced diameter or number when compared with conventional designs.

To assemble internal combustion engine 10, cylinder liner 16 is inserted within cylinder bore 24 of cylinder block 12. Scraping ring 20 is placed within annular recess 62 at distal end 44 of cylinder liner 16. When placed within recess 62, scraping ring 20 extends from distal end 44 of cylinder liner 16 as shown in FIG. 2. Sealing ring 22 is then placed radially around scraping ring 20 against distal end 44 of cylinder liner 16. When scraping ring 20 and sealing ring 22 are both installed, sealing ring 22 extends slightly above scraping ring 20. Piston 18, with piston rings 42 thereon, is then installed within cylinder liner 16. Of course, piston 18 may also be installed within cylinder liner prior to installation of scraping ring 20 and sealing ring 22. Cylinder head 14 is then placed over cylinder bore 24 and attached to cylinder block 12 using suitable fasteners such as bolts (not shown). The torque values applied to the bolts are selected to provide adequate sealing between cylinder head 14 and cylinder block 12, dependent upon material types used, etc.

Other aspects, objects and advantages of this invention can be obtained from a study of the drawings, the disclosure and the appended claims.

What is claimed is:

1. An internal combustion engine, comprising:

a cylinder block having a cylinder bore;

a cylinder head attached to said cylinder block and covering said cylinder bore;

a cylinder liner within said cylinder bore, said cylinder liner having a distal end, an inside diameter, and an annular recess extending radially outwardly from said inside diameter at said distal end;

a piston reciprocally disposed within said cylinder liner;

an annular scraping ring positioned in said annular recess, said scraping ring having an inside diameter which is smaller than said inside diameter of said cylinder liner and configured to scrape deposits from said piston, said scraping ring extending axially beyond said distal end of said cylinder liner; and an annular sealing ring separate from, located by and positioned radially outwardly adjacent to said scraping ring, said sealing ring directly engaging and sealing between said cylinder head and said distal end of said cylinder liner.

2. The internal combustion engine of claim 1, wherein said cylinder liner has a longitudinal axis, said scraping ring has a cross section extending generally parallel to said longitudinal axis, and said sealing ring has a cross section extending generally orthogonal to said longitudinal axis.

3. The internal combustion engine of claim 1, wherein said scraping ring and said cylinder liner are comprised of a same material.

4. The internal combustion engine of claim 1, wherein said scraping ring is positioned a slight distance away from said cylinder head.

5. The internal combustion engine of claim 1, wherein said sealing ring is comprised of steel.

6. The internal combustion engine of claim 1, wherein said sealing ring, said cylinder liner and said cylinder head are each comprised of a metal with a similar coefficient of thermal expansion.

7. A method of assembling an internal combustion engine, comprising the steps of:

inserting a cylinder liner within a cylinder bore of a cylinder block, said cylinder liner having a distal end, an inside diameter, and an annular recess extending radially outwardly from said inside diameter at said distal end;

placing an annular scraping ring within said annular recess, said scraping ring having an inside diameter which is smaller than said inside diameter of said cylinder liner and configured to scrape deposits from a piston, said scraping ring extending axially beyond said distal end of said cylinder liner;

locating an annular sealing ring separate from and radially outwardly adjacent to said scraping ring against said distal end of said cylinder liner;

covering said cylinder bore with a cylinder head; and attaching said cylinder head to said cylinder block, whereby said sealing ring directly engages and seals between said cylinder head and said distal end of said cylinder liner.

* * * * *